US006565924B2

(12) United States Patent
Babu et al.

(10) Patent No.: US 6,565,924 B2
(45) Date of Patent: May 20, 2003

(54) TEXTILE TREATMENT PROCESS AND PRODUCT

(75) Inventors: Gangundi Prakash Babu, Mumbai (IN); Vinodkumar Ramniranjan Dhanuka, Mumbai (IN); Kaushik Narotam Divecha, Mumbai (IN); Manish Hardas Keswani, Jalgaon (IN); Raghavachari Rajan, Bangalore (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/920,486

(22) Filed: Aug. 1, 2001

(65) Prior Publication Data

US 2002/0034588 A1 Mar. 21, 2002

(30) Foreign Application Priority Data

Aug. 1, 2000 (IN) ..... 720/00
Sep. 15, 2000 (GB) ..... 0022704

(51) Int. Cl.[7] ..... B05D 3/10; B05D 3/02

(52) U.S. Cl. ..... 427/344; 427/342; 427/381; 427/397.7; 427/397.8

(58) Field of Search ..... 427/180, 397.7, 427/397.8, 394, 381, 342, 344

(56) References Cited

U.S. PATENT DOCUMENTS

| | | | | | |
|---|---|---|---|---|---|
| 1,808,068 | A | | 6/1931 | Rafton | |
| 2,097,589 | A | | 11/1937 | Dreyfus | 91/68 |
| 2,418,525 | A | * | 4/1947 | Pollak | 106/18.14 |
| 2,864,723 | A | * | 12/1958 | Fluck et al. | 427/389.9 |
| 3,607,356 | A | * | 9/1971 | Beninate et al. | 427/341 |
| 3,736,259 | A | | 5/1973 | Buck et al. | 252/89 |
| 3,912,841 | A | | 10/1975 | Payne et al. | 428/96 |
| 4,035,148 | A | | 7/1977 | Metzger et al. | 8/137 |
| 4,486,347 | A | * | 12/1984 | Gorbacheva et al. | 534/781 |
| 4,566,980 | A | | 1/1986 | Smith | 252/8.6 |
| 4,773,483 | A | * | 9/1988 | Paul | 166/270 |
| 4,868,012 | A | | 9/1989 | Demoulin | 427/208.2 |
| 4,873,000 | A | | 10/1989 | Weller | 252/8.6 |

FOREIGN PATENT DOCUMENTS

| | | | | |
|---|---|---|---|---|
| CH | 418 815 | | 2/1967 | |
| EP | 643 166 | | 3/1995 | |
| EP | 643166 | A2 * | 3/1995 | D21H/17/70 |
| EP | 0 881 321 | | 12/1998 | |
| WO | 93/17173 | | 9/1993 | |
| WO | 94/08086 | | 4/1994 | |
| WO | 98/42909 | | 10/1998 | |
| WO | 01/44561 | | 6/2001 | |

OTHER PUBLICATIONS

GB Search Report in a GB application GB 0022704.1.
Co–pending Application: Applicant: Bird et al., S/N: 09/737, 605, Filed: Dec. 15, 2000
PCT International Search Report in a PCT application PCT/EP 01/07562

* cited by examiner

*Primary Examiner*—Michael Barr
(74) *Attorney, Agent, or Firm*—Rimma Mitelman

(57) ABSTRACT

A process for treating a yarn and/or a fabric to form fine inorganic particulate material in the intra-yarn pores and/or on the surface of the fibers constituting the yarn or fabric, which would substantially maintain fabric reflectance after repeated wash/wear cycles without affecting the desired characteristics of air permeability. The inorganic particles are preferably formed by reacting in an aqueous medium a first reagent selected from mineral and organic acids and a second reagent selected from alkali or alkaline earth metal salts with inorganic anions. The invention also relates to a treatment product composition directed to provide instant inorganic deposits in the yarn or fiber surface.

11 Claims, No Drawings

TEXTILE TREATMENT PROCESS AND PRODUCT

TECHNICAL FIELD

The present invention relates to a process for treating a yarn and/or a fabric to form a fine inorganic particulate material in the intra-yarn pores and/or on the surfaces of the fibres constituting the yarn or fabric, which would substantially maintain fabric reflectance after repeated wash/wear cycles without affecting the desired characteristics of air permeability. The invention also relates to a treatment product composition directed to provide instant inorganic deposits in the yarn or fibre surface.

BACKGROUND AND PRIOR ART

It is well known that yarns used for producing fabrics and the fabrics so obtained have pores. In particular, the yarns per se, have inter-fibre pores while the fabric obtained of such yarn apart from such inter-fibre/intra-yarn pores also have inter-yarn pores. It is found that during use of the fabric, particulate soils and/or oily soils get trapped in the minute intra-yarn pores which get firmly bonded to the yarn or fabric.

In a typical hand washing cleaning operation using a detergent solution, the yarn or fabric has the detergent applied to it or it is soaked in the solution which is then followed by rubbing with a brush to dislodge and remove soil and particles from the soiled fabric. By the action of rubbing with a hard surface in presence of a conventional detergent product the cleaning is generally satisfactory. Machine wash is another method used for cleaning fabric where the mechanical agitation in presence of a detergent composition is used to dislodge the soil particles to achieve necessary cleaning.

An unsoiled new fabric generally has a reflectance value of about 88 when measured at a wavelength of 460 nm with UV filter. It is found that following soiling and wash regimes, fabric reflectance may drop to below 65 leading to greying of the fabric. It is established that smaller dirt/soil particles pose a serious challenge in terms of their removal since they accumulate in intra-yarn pores and on the fibre surface. Such small soil particles deposited in or on the fabric are the main cause for decline in fabric reflectance.

U.S. Pat. No. 4,035,148 (Procter & Gamble), U.S. Pat. No. 4,566,980 (Creative Products) and U.S. Pat. No. 4,873,000 (Sterling Drug) disclose carpet treatment products which involve particulate material deposits in the carpet fibres. The particles are subsequently vacuumed off together with any dirt or soil to which they are associated. All the available art uses "external deposition" techniques i.e. particulates were taken in bulk solution and deposited onto the fabric and then removed.

WO 9842909 (Koala Konnections) discloses a fabric with UV blocking particles bound to the fabric by binding agents. It discloses the process of deposition followed by heat treatment.

In the pending application GB 9929838.2 (Unilever) fine particles of clay are deposited on the fabric which block the inter-fibre regions of the fabric thus preventing the entrapment of environmental soil into the fabric. In order to maintain the reflectance of the fabric it needs to be retreated for deposition of fresh sacrificial layer after each wash and wear cycle. Although this provides satisfactory cleaning, the deposit of the clay on the fabric blocks the inter-fibre and inter-yarn regions which lead to substantial reduction in air flow passage through the fabric adding to the discomfort of the wearer of the fabric.

The present inventors have surprisingly found that a fabric or yarn which comprises fine particulate inorganic particles either on the surface or in the pores of the fibres maintains the fabric reflectance after repeated wash/wear cycles without affecting the desired characteristics of air permeability.

DEFINITION OF THE INVENTION

According to a first aspect, the present invention provides a process for the production of a treated textile yarn or fabric which comprises treating the yarn or fabric with at least two reagents capable of reacting together to form a fine inorganic particulate material, whereby the fine inorganic particulate material is precipitated in the intra-yarn pores and/or on the surfaces of the fibres constituting the yarn or fabric.

According to a second aspect, the invention provides a treatment product comprising at least two separate ingredients capable of reacting together in an aqueous medium to form a fine inorganic particulate material, preferably having a particle size not exceeding 5 $\mu$m.

DETAILED DESCRIPTION OF THE INVENTION

The Process For the Production of a Treated Textile Yarn or Fabric

In this first aspect of the invention, the fine inorganic particulate material in the intra-yarn pores and/or on the fibre surface can be provided by reacting in an aqueous medium a first reagent selected from mineral and organic acids and a second reagent selected from alkali or alkaline earth metal salts with inorganic anions.

The mineral acid may be selected from hydrochloric acid, sulphuric acid, nitric acid or phosphoric acid. If hydrochloric acid is used it is preferably at a concentration of from 0.1 to 0.8 gmol/l. If phosphoric acid is used it is preferably at a concentration of from 0.02 to 0.2 gmol/l.

The inorganic anion may be selected from silicate, aluminate, carbonate, hydroxide, phosphate, chloride, sulphate or nitrate and preferably aluminate or silicate.

In a first preferred embodiment, the process of producing the treated fabric/yarn comprises:

(a) treating the yarn or fabric with one of the first and second reagents in aqueous solution, (b) subsequently, treating the yarn or fabric with the other of the first and second reagents in aqueous solution to facilitate deposition of the inorganic particulate in the intra-yarn pores and/or fibre surface.

Preferably in the above process, in step (a) the yarn or fabric is treated with the reagent solution having the lower diffusion coefficient. This is to prevent the first reagent from coming out of the intra yarn pores when the second reagent is added to the yarn or fabric. The second reagent with higher diffusion coefficient penetrates into the intra yarn pores and reacts with the first reagent which is already present there.

In a second preferred embodiment, the process of producing the treated fabric or yarn comprises treating the fabric or yarn with an aqueous solution of alkali metal silicate and urea whereby silica is precipitated in the intra-yarn pores and/or on the surfaces of the fibres constituting the yarn or fabric.

In a third preferred embodiment such a process comprises treating the yarn or fabric with a dilute alkali metal silicate solution, through which $CO_2$ is bubbled, whereby silica is precipitated in the intra-yarn pores and/or on the surfaces of the fibres constituting the yarn or fabric.

Alternatively, the process of producing the treated fabric/yarn comprises treating the yarn or fabric with a dilute alkali metal silicate solution followed by drying the yarn or fabric in air, whereby silica is precipitated in the intra-yarn pores and/or on the surfaces of the fibres constituting the yarn or fabric.

Preferably the drying is carried out for a period of at least two hours such that complete conversion of the alkali metal silicate into silica is achieved. The deposition of silica is dependent upon the concentration of the alkali metal silicate solution as well as the drying time and the deposition can be varied depending upon the desired end deposit on the yarn/fabrics.

It is found that yarn or fabric treated by the above process has deposits of fine inorganic particulate material providing for reduced soiling of fabrics, including oily soils, and maintaining higher reflectance in repeated wear/wash cycles.

It is believed that the yarn or fabric treated by the above process has selective deposition of the particulate material only in the small intra-yarn pores and not in the inter-yarn regions which provides firstly, the maintenance of fabric reflectance even after repeated wash/wearing cycles is achieved and secondly, the desired air permeability through the fabric pores is maintained to provide comfort in use or wearing of the fabric.

The Treatment Product

The second aspect of the present invention is a treatment product which comprises at least two separate ingredients capable of reacting together in an aqueous medium to form a fine inorganic particulate material, preferably having a particle size not exceeding 5 $\mu$m. It is preferred that the product comprises (a) at least one first ingredient selected from mineral and organic acids and (b) at least one second ingredient selected from alkali or alkaline earth metal salts with inorganic anions wherein (a) and (b) are capable of reaction in an aqueous medium to form a fine inorganic particulate material.

The product is preferably accompanied with an instruction manual detailing directions of use of the product for carrying out in-situ deposition of the inorganic particulate material in the intra-yarn pores and/or on the surfaces of the fibres constituting the yarn or fabric.

The constituent (a) of the product is preferably a mineral acid, preferably selected from, hydrochloric acid, sulphuric acid, nitric acid and phosphoric acid. Alternatively it is also preferred that (a) is an organic acid, preferably selected from citric acid, acetic acid and lauric acid or a combination thereof.

The constituent (b) of the product is selected to have an inorganic anion selected from alkali metal silicate, aluminate, carbonate, hydroxide, phosphate, chloride, sulphate or nitrate and preferably aluminate or alkali metal silicate.

In a first preferred embodiment of the invention, ingredient (a) comprises hydrochloric acid in a concentration of from 0.1 to 0.8 gmol/l and (b) comprises sodium aluminate in a concentration of from 0.1 gmol/l to 0.8 gmol/l.

In a second preferred embodiment of the invention, ingredient (a) comprises phosphoric acid in amount of 0.02 gmol/l to 0.2 gmol/l and (b) comprises sodium aluminate in a concentration of 0.1 gmol/l to 1.0 gmol/l.

In a third preferred embodiment of the invention, ingredient (a) comprises a mineral acid selected from hydrochloric acid in a concentration of from 0.1 to 0.8 gmol/l and phosphoric acid in a concentration of from 0.02 to 0.2 gmol/l and (b) comprises alkaline earth metal salt selected from sodium aluminate and sodium silicate in a concentration of from 0.04 gmol/l to 0.4 gmol/l.

The invention is further illustrated by the following non-limiting Examples.

EXAMPLES

Examples 1 to 4 and Comparative Example A

In this example, in-situ deposition of aluminium trihydrate was carried out by wicking a yarn/fabric in hydrochloric acid and a solution of sodium aluminate.

The wicking was carried out by hanging the swatch vertically by means of threads in such a way that bottom edge of swatch just dips inside the first solution kept below. After wicking was complete the swatch was kept in a horizontal position and the second solution was added to the swatch uniformly and dried for 24 hours. The concentration of the solution was determined using the stoichiometry and based on the percentage weight addition of precipitate on the fabric.

In Example 1 the fabric was first wicked under hydrochloric acid followed by sodium aluminate solution to produce aluminium trihydrate particles. In Example 2 the fabric was first wicked under sodium aluminate solution followed by hydrochloric acid to produce aluminium trihydrate particles. In Example 3 the fabric was only wicked in hydrochloric acid which could be further treated with sodium aluminate solution to provide a treated fabric according to the present invention. In Example 4 the fabric was only wicked in sodium aluminate solution which could be further treated with hydrochloric acid to provide a treated fabric according to the present invention. In Comparative Example A, the fabric was untreated.

All the fabrics were then subjected to a soiling and wash protocol described below.

Soiling and Wash Protocol

The fabrics were soiled artificially with particulate soil and sebum to provide a much reduced reflectance value.

The fabrics after soiling were soaked in 2.5 g/l commercial detergent solution in water. The composition of the commercial detergent used is described in Table 1. Three swatches were soaked in detergent solution. After soaking, the swatches were mechanically agitated in a water shaker for 30 minutes. After the mechanical agitation, the swatches were rinsed three times using water. Then the swatches were taken out and dried. This protocol was followed for 6 cycles.

TABLE 1

| Composition | Concentration (wt %) |
|---|---|
| Na linear alkylbenzene sulphonate | 25 |
| Nonionic surfactant $C_{12}EO_7$ | 0.5 |
| Nonionic surfactant $C_{12}EO_3$ | 1.5 |
| Soda ash | 23 |
| Sodium tripolyphosphate | 32 |
| Silica | 5.9 |
| Water | To 100 |

Reflectance Measurement

Colour Eye 7000 A (Gretag Macbeth) instrument was used for reflectance measurements. The reflectance of fabric was monitored at the wavelength of 460 nm with UV filter. The reflectance value of the original fabric was about 88. The reflectance value was measured before the first soiling after the treatment. Each soiling and wash forms one cycle.

To assess the reflectance maintenance the reflectance values after cycle 1 and cycle 6 were noted and are shown in Table 2.

TABLE 2

| Example | Reflectance Value | |
|---|---|---|
| | After cycle 1 | After cycle 6 |
| 1 | 86.5 | 84.4 |
| 2 | 87.7 | 86.9 |
| 3 | 84.9 | 81.6 |
| 4 | 86.6 | 83.0 |
| A | 85.6 | 81.2 |

Examples 5 to 7 and Comparative Example B

In Example 5 the fabric was first wicked under phosphoric acid followed by sodium aluminate solution to produce aluminium trihydrate particles. In Example 6 the fabric was first wicked under sodium aluminate solution followed by phosphoric acid to produce aluminium trihydrate particles. In Example 7 the fabric was first wicked in sodium silicate solution followed by sodium aluminate to produce sodium aluminium silicate particles. In Comparative Example B, the fabric was untreated.

The reflectance values noted after cycle 1 and cycle 6 and compared with reflectance values of untreated fabric. The results obtained are shown in Table 3.

TABLE 3

| Example | Reflectance Value | |
|---|---|---|
| | After cycle 1 | After cycle 6 |
| 5 | 88.4 | 86.7 |
| 6 | 88.2 | 88.4 |
| 7 | 88.1 | 85.4 |
| B | 87.8 | 82.0 |

Example 8 and Comparative Example C

The air permeability of the treated fabric of Example 1 and the untreated fabric of Comparative Example A were measured according to the Anderson protocol. This utilises a known area of material, of known thickness, across which a constant pressure difference is imposed. The air permeability of the fabric is calculated by measuring the resultant velocity of air through the fa bric and applying Darcy's law. In one particular form Darcy's law states:

$$\frac{V}{A} = \frac{K\Delta P}{\mu x}$$

in which, V is the volumetric flow rate ($m^3/s$), A is the area of the fabric ($m^2$), K is the permeability ($m^2$), $\Delta P$ is the pressure difference across the fabric ($N/m^2$), $\mu$ is the viscosity of air (kg/ms), and x is the thickness of the fabric (m).

Thus the permability, K, is measured by the above protocol. The physical constants for these experiments were as follows: $A=10^{-5}$ $m^2$; $\Delta P=200$ $N/m^2$; $\mu=1.85\times10^{-5}$ kg/ms; $x=2\times10^{-4}$ m.

The fabric permeability of the treated fabric of Example 1 and the untreated fabric of Comparative Example A after each exposure-wash cycle, was measured after each wash. The air permeability data are given in Table 4.

TABLE 4

| No. of wash cycles | Permeability, K ($m^2$) | |
|---|---|---|
| | 8 | C |
| None (fresh fabric) | 11.4 | 11.4 |
| 1 | 11.0 | 11.2 |
| 3 | 10.6 | 10.2 |
| 6 | 9.2 | 8.5 |

As would be evident from the above result after six wash/soil cycles the air permeability of treated fabric is reduced only by 20% while those of untreated fabric air-permeability reduced by more than 25%. This is basically due to the in-situ deposition on the treated fabric of the invention substantially in the intra yarn pores and not in the inter yarn regions. The permeability of untreated fabric was lower than the treated ones due to particulate soil accumulation.

Examples 9 to 11 and Comparative Example D

The following examples further illustrate other possible methods of deposition of inorganic particulate such as silica.

In Example 9 a fabric of weight 12 g was treated with 30 g of a solution of neutral sodium silicate and 20 g of urea in 300 ml of water and was heated to 95° C. and maintained at that temperature for 4 hours. In this way silica was deposited by the in-situ precipitation method. The fabric was subsequently rinsed in water and dried.

In Example 10 a fabric was soaked in a 15% neutral sodium silicate solution and $CO_2$ gas was bubbled into it for 4 hours. In this way silica was deposited by bubbling $CO_2$ gas through sodium silicate solution. The fabric was rinsed in water and dried.

In Example 11 initially the fabric was soaked in 15% neutral sodium silicate solution and then dried in the air for 24 hours. The reaction between $CO_2$ (from air) and sodium silicate (on the fabric) resulted in silica deposition. The fabric was rinsed in water and dried.

In Comparative Example D the fabric was untreated.

The fabrics were subjected to a soiling and wash protocol and reflectance measurements are as described above and the reflectance measurements were done after one and ten cycles and the results are presented in Table 5.

TABLE 5

| Example | Reflectance Value | |
|---|---|---|
| | After cycle 1 | After cycle 10 |
| 9 | 85 | 77 |
| 10 | 84 | 71 |
| 11 | 82.8 | 72.2 |
| D | 82 | 68 |

It is thus possible by way of the present invention to provide treated yarn/fabric with selective in-situ deposition of inorganic material which would both provide for maintenance of fabric reflectance even after repeated soiling and wash cycles and will not adversely affect the desired air permeability for the fabric.

We claim:

1. A process for the production of a treated textile yam or fabric which comprises treating a textile yarn or fabric with at least two reagents capable of reacting together to form a inorganic particulate material having a particle size not exceeding 5 microns, whereby the inorganic particulate material is precipitated substantially in the intra-yarn pores and not in the interyarn regions.

2. A process as claimed in claim 1, wherein the fine inorganic particulate material is formed by reacting in an aqueous medium a first reagent selected from mineral and organic acids and a second reagent selected from alkali or alkaline earth metal salts with inorganic anions.

3. A process as claimed in claim 2, wherein the first reagent is a mineral acid selected from hydrochloric acid, sulphuric acid, nitric acid or phosphoric acid.

4. A process as claimed in claim 3, wherein the first reagent is hydrochloric acid having a concentration of from 0.1 to 0.8 gmol/l or phosphoric acid having a concentration of from 0.02 to 0.2 gmol/l.

5. A process as claimed in claim 1, wherein the second reagent is a salt having an inorganic anion selected from silicate, aluminate, carbonate, hydroxide, phosphate, chloride, sulphate or nitrate.

6. A process as claimed in claim 5, wherein the second reagent is aluminate or silicate.

7. A process as claimed in claim 2, comprising:

(a) treating the yarn or fabric with one of the first and second reagents in aqueous solution, (b) subsequently, treating the yarn or fabric with the other of the first and second reagents in aqueous solution.

8. A process as claimed in claim 7, wherein in step (a) the yarn or fabric is treated with the reagent solution having the lower diffusion coefficient.

9. A process as claimed in claim 1, which comprises treating the yarn or fabric with an aqueous solution of alkali metal silicate and urea whereby silica is precipitated in the intra-yarn pores of the fibres constituting the yarn or fabric.

10. A process as claimed in claim 1, which comprises treating the yarn or fabric with a aqueous alkali metal silicate solution, through which $CO_2$ is bubbled, whereby silica is precipitated in the intra-yarn pores of the fibres constituting the yarn or fabric.

11. A process as claimed in claim 1, which comprises treating the yarn or fabric with a aqueous alkali metal silicate solution followed by drying the yarn or fabric in air, whereby silica is precipitated in the intra-yarn pores of the fibres constituting the yarn or fabric.

* * * * *